US010100511B2

(12) United States Patent
Boyd et al.

(10) Patent No.: US 10,100,511 B2
(45) **Date of Patent: *Oct. 16, 2018**

(54) EMBEDDED DOWEL INSERTS WITH DOWEL RETENTION MECHANISMS AND DOWEL INSERT TUBE EXTENDERS

(71) Applicants: Stephen Boyd, Holbrook, NY (US); Joseph Accetta, Old Bridge, NY (US)

(72) Inventors: Stephen Boyd, Holbrook, NY (US); Joseph Accetta, Old Bridge, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/828,888

(22) Filed: Dec. 1, 2017

(65) Prior Publication Data

US 2018/0087265 A1 Mar. 29, 2018

Related U.S. Application Data

(63) Continuation-in-part of application No. 15/293,401, filed on Oct. 14, 2016, now Pat. No. 9,834,922, which is a continuation of application No. 13/964,834, filed on Aug. 12, 2013, now Pat. No. 9,469,994.

(51) Int. Cl.

| | |
|---|---|
| ***E04B 1/41*** | (2006.01) |
| ***E04B 1/48*** | (2006.01) |
| ***E01C 23/04*** | (2006.01) |
| ***E04G 21/18*** | (2006.01) |
| ***E04C 5/16*** | (2006.01) |

(52) U.S. Cl.

CPC ..... *E04B 1/4114* (2013.01); *E01C 23/04* (2013.01); *E04B 1/41* (2013.01); *E04B 1/48* (2013.01); *E04B 1/483* (2013.01); *E04C 5/161* (2013.01); *E04G 21/185* (2013.01)

(58) Field of Classification Search

CPC . E04B 1/48; E04B 1/483; E01C 11/14; E01C 23/04

See application file for complete search history.

(56) References Cited

U.S. PATENT DOCUMENTS

| | | | | |
|---|---|---|---|---|
| 1,045,562 A | | 11/1912 | Kennedy | |
| 3,265,349 A | * | 8/1966 | Hamrick | E04G 15/061 220/690 |
| 5,005,331 A | * | 4/1991 | Shaw | E01C 11/14 52/396.02 |
| 5,216,862 A | * | 6/1993 | Shaw | E01C 11/14 52/396.02 |
| 5,487,249 A | | 1/1996 | Shaw et al. | |

(Continued)

*Primary Examiner* — Andrew J Triggs

(74) *Attorney, Agent, or Firm* — Osborne Law LLC

(57) ABSTRACT

A dowel supporting device that includes a substantially hollow tube having a top end and a bottom end. An opening may be formed at the top end and a base may be formed at the bottom end. The base of the dowel supporting device may be fastened to a concrete deck. Concrete may be poured into the concrete deck. When dowels are ready to be used, the dowels may be inserted and secured to the dowel supporting device. A cap or thin sealed covering may be placed at the top end of the hollow tube to prevent infiltration of concrete into the tube during a concrete pour. The cap or thin sealed covering may include a raised portion of material which aids in locating the hollow tube after a concrete slab cures around it. A dowel tube extender may be provided which extends a hollow tube to accommodate different concrete slab thicknesses.

20 Claims, 4 Drawing Sheets

(56) References Cited

U.S. PATENT DOCUMENTS

| | | | | |
|---|---|---|---|---|
| 5,934,821 | A * | 8/1999 | Shaw | E01C 11/14 404/62 |
| 5,941,045 | A * | 8/1999 | Plehanoff | E04B 1/483 52/396.02 |
| 7,487,949 | B2 * | 2/2009 | Bennett | B28B 7/30 249/177 |
| 7,887,735 | B2 * | 2/2011 | Bennett | B28B 7/30 264/317 |
| 7,967,528 | B2 * | 6/2011 | Mercer | E04B 1/483 404/60 |
| 8,142,104 | B2 * | 3/2012 | Mercer | E04B 1/483 404/134 |
| 8,511,033 | B2 | 8/2013 | Kumakawa et al. | |
| 9,834,922 | B2 * | 12/2017 | Boyd | E04B 1/4114 |
| 2009/0139179 | A1 | 6/2009 | Bennett | |
| 2014/0047787 | A1 | 2/2014 | Boyd et al. | |

* cited by examiner

EMBEDDED DOWEL INSERTS WITH DOWEL RETENTION MECHANISMS AND DOWEL INSERT TUBE EXTENDERS

CROSS-REFERENCE TO RELATED APPLICATIONS

This application claims the benefit of priority of U.S. provisional application No. 61/683,042, filed Aug. 14, 2012, the contents of which are herein incorporated by reference. This application is a continuation-in-part of application Ser. No. 15/293,401, the disclosure of which is incorporated herein by reference, which is a continuation of application Ser. No. 13/964,834 (issued as U.S. Pat. No. 9,469,994), the disclosure of which is incorporated herein by reference.

BACKGROUND OF THE INVENTION

The present invention relates to embedded dowel inserts and, more particularly, to embedded dowel inserts for concrete application. Currently, during new concrete construction, steel dowels may be embedded in the concrete for the construction of a building. The steel dowels are left exposed and protruding from the cured concrete. The dowels may expose construction workers to impalement. To prevent this, the dowels need to be covered with materials. As can be seen, there is a need for a device that prevents the dowels from being exposed.

SUMMARY OF THE INVENTION

In one aspect of the present invention, a dowel supporting device comprises: a substantially hollow tube having a top end and a bottom end, wherein the substantially hollow tube forms an opening at the top end formed to receive a dowel; and a base at the bottom end comprising a fastening component.

In another aspect of the present invention, a method of securing dowels during construction comprises: providing at least one substantially hollow tube having a top end and a bottom end, wherein the substantially hollow tube forms an opening at the top end, and the bottom end comprises a base; fastening the base of the substantially hollow tube to a concrete deck; pouring concrete within the concrete deck; and inserting a dowel into the opening of the substantially hollow tube.

in another aspect of the invention, a substantially hollow tube contains one or more grooves or depressions in the inner wall of the hollow tube to retain a dowel in the hollow tube in concert with an adhesive.

In another aspect of the invention, a dowel insert tube extender comprises a second hollow tube having a bottom end and a top end and an opening at the top end, wherein the second hollow tube is sized to receive and secure a dowel by insertion of a dowel through the opening at the top end wherein the bottom end of said second hollow tube is configured for mating engagement with the top end of a first hollow tube.

In another aspect of the invention, a substantially hollow tube contains one or more rings, ridges or other raised portions of material on its exterior surface which produce a rigid, non-detachable connection to the concrete slab once the slab has cured.

These and other features, aspects and advantages of the present invention will become better understood with reference to the following drawings, description and claims.

DETAILED DESCRIPTION OF THE INVENTION

Figure 1:
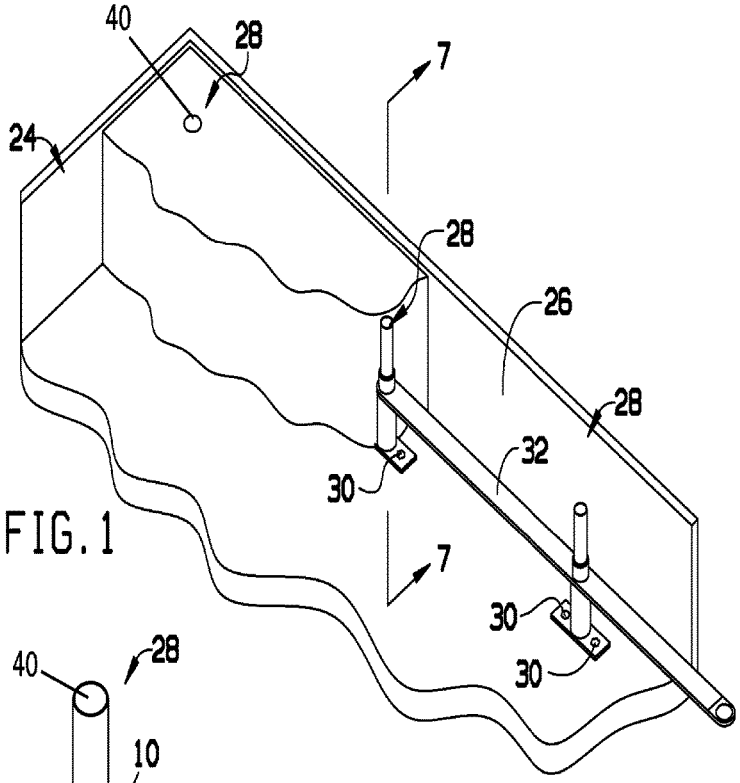
FIG. 1 is a perspective view of the present invention in use.
Figure 5:
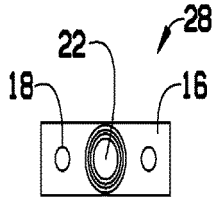
FIG. 5 is a top view of the present invention.
Figure 2:
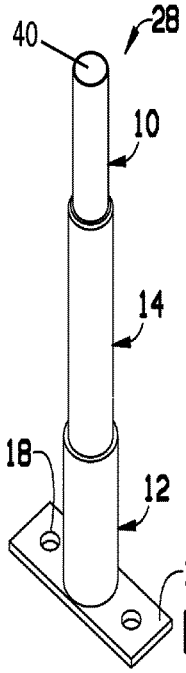
FIG. 2 is a perspective view of the present invention.
Figure 3:
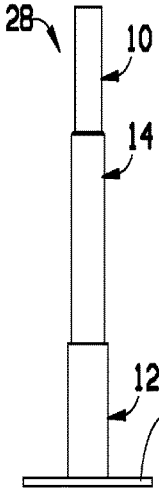
FIG. 3 is a front view of the present invention.
Figure 4:
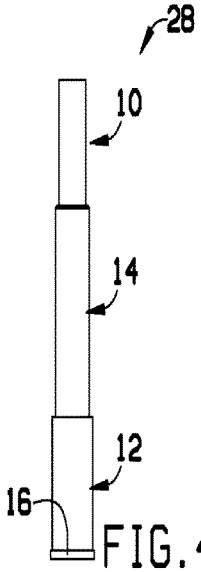
FIG. 4 is a side view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a dowel supporting device that is a substantially hollow tube having a top end and a bottom end. An opening may be formed at the top end and a base may be formed at the bottom end. The base of the dowel supporting device may be fastened to a concrete deck. Concrete may be poured into the concrete deck. When dowels are ready to be used, the dowels may be inserted into and secured to the dowel supporting device.

The present invention may include a pre-molded assembly of tubes installed in concrete to support metal dowels. The pre-molded tube assemblies may be placed and mechanically fastened to surfaces prior to the placement of concrete. Once the concrete has been laid, and the use for dowels is needed, the steel dowels may be placed and secured within the tubes. In certain embodiments, epoxy may be used within the tubes to secure the metal dowels.

This process may eliminate the dangerous exposure of dowels that could be the cause of impalement. In addition, the process may reduce the cost of maintaining exposed dowels by using covers. The tubes of the present invention may be made of a resin, or non-corrosive lightweight material including but not limited to polymers, such as plastic, polyvinyl chloride, and fiberglass.

Referring to FIGS. 1 through 12, the present invention may include a dowel insert tube 28 that may include a top end and a bottom end. The dowel insert tube 28 forms an opening 40 at the top end shaped to receive a dowel 36. A base 16 may form at the bottom end. In certain embodiments, the base 16 may include fastener holes 18 in which fasteners 30, such as bolts or screws, may be secured through to fasten the base 16 to a surface of a concrete deck 24.

In certain embodiments, the dowel insert tube 28 may include an adjustable leg section 12 near the bottom end, a mid section 14 and an upper tube section 10 near the top end. The leg section 12 may have a larger diameter than the mid section 14 and the mid section 14 may have a larger diameter than the upper tube section 10. The leg section 12, mid section 14, and upper tube section 10 may telescope relative to one another to adjust the height of the dowel insert tube 10.

Figure 6:
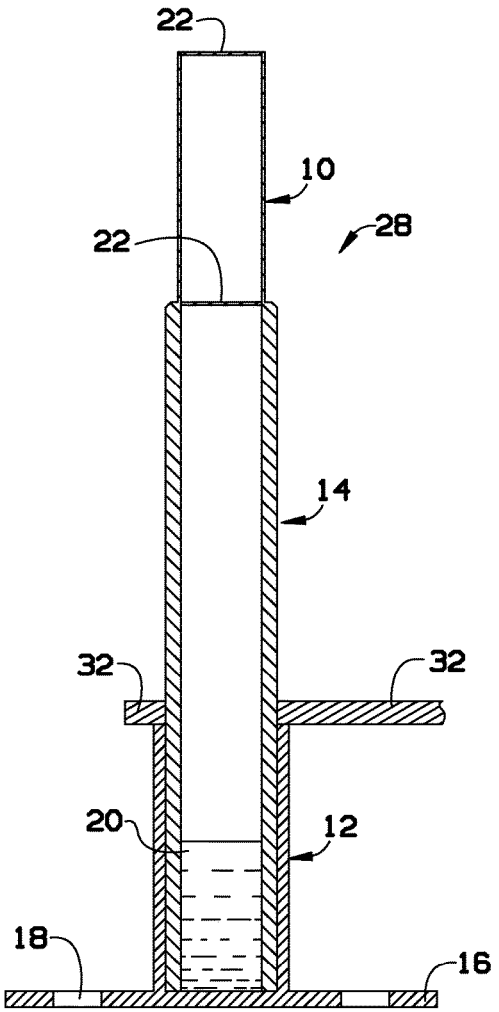
FIG. 6 is a section view of the present invention along line 7-7 in FIG. 1.
Figure 7:
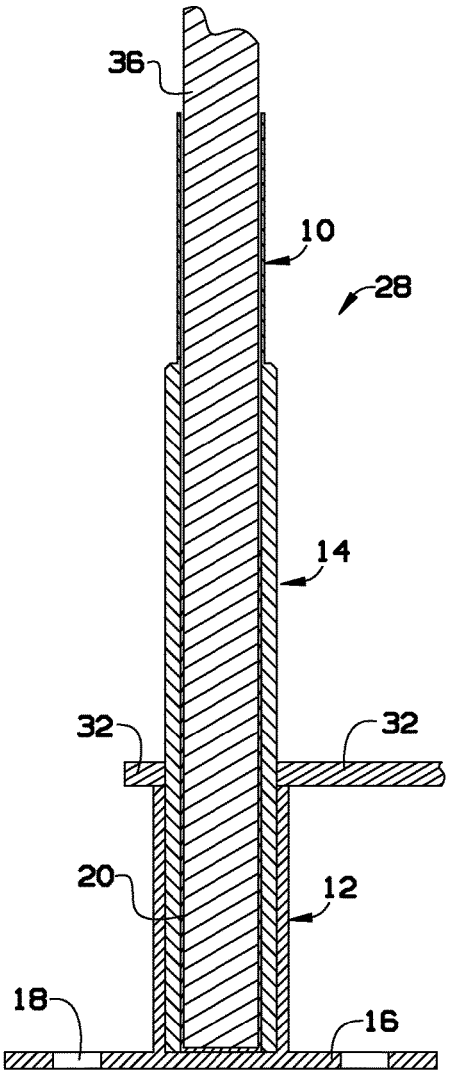
FIG. 7 is a section view of the present invention along line 7-7 in FIG. 1 illustrated with a dowel inserted.
Figure 8:
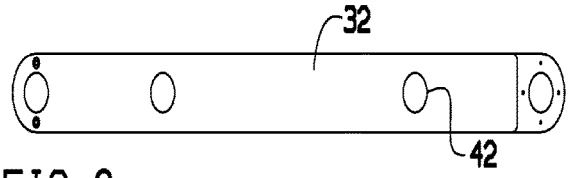
FIG. 8 is a top view of a rigid plastic tie of present invention.
Figure 9:
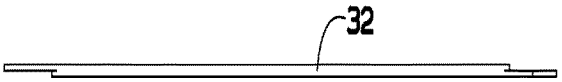
FIG. 9 is a side view of the rigid plastic tie of FIG. 8.
Figure 10:
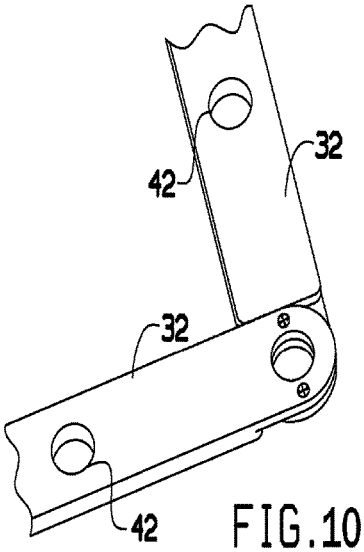
FIG. 10 is a perspective view of two rigid plastic ties joined together.
Figure 11:
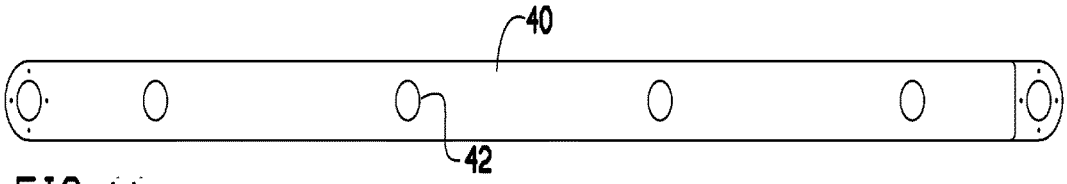
FIG. 11 is a top view of an alternative rigid plastic tie of the present invention.
Figure 12:
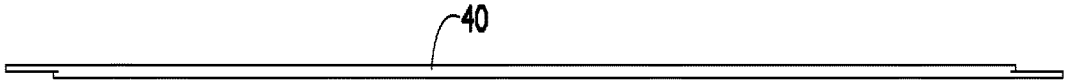
FIG. 12 is a side view of the rigid plastic tie of FIG. 11.

In certain embodiments, the present invention may have a cap 22 such as a thin sealed covering. As illustrated in FIG. 6, the cap 22 may be located at the top of the upper tube section 10 as well as the top of the mid section 14. In certain embodiments, glue, such as epoxy 20 may be stored within the dowel insert tube 28 and the cap 22 may preserve the epoxy 20. Therefore, when the dowel insert tube 28 is ready to be used, the cap 22 may be removed or punctured by the dowel 36 and the dowel 36 may be placed within the tube 28. Alternatively, the cap 22 may be removed and epoxy 20 may be inserted into the tube 28. Then the dowel 36 may be placed within the dowel insert tube 28. The epoxy 20 may secure the dowel 36 in the dowel insert tube 28. It should be appreciated that the epoxy or adhesive could be comprised of a two-part mixture pre-packaged in separate containers in the dowel tube which reacts upon being mixed to harden, or the epoxy or adhesive could be a single part compound which reacts with oxygen, after the dowel is inserted into the tube and pierces the adhesive container(s). It should also be appreciated that the cap 22 could be manufactured integrally with the hollow tube and the epoxy or adhesive inserted into the tube through an opening in the base 16 at the bottom end of the hollow tube.

Figure 13:
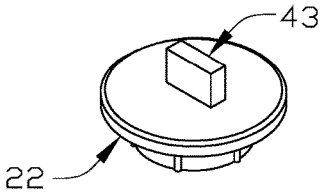
FIG. 13 is a perspective view of a dowel insert tube cap with a projection at its top surface.

As shown in FIG. 13, in still further embodiments the cap 22 may include a projection 43 at its top-most surface which aids in locating the cap after concrete has cured around it. For example, the projection may comprise a raised portion of material and/or a deformable projection which extends upward. The raised portion of material would be discernible after a slab hardens around the tube/cap, but would not interfere with working or troweling of the concrete while it is wet and uncured. Similarly, a deformable projection would deform or bend during working or troweling of the surface of the wet concrete but would spring back up after a working implement passes over it, thereby producing a vertically extending projection which aids location of the cap and dowel tube after the slab hardens. It should be appreciated that a raised portion or a deformable projection could be used separately, or they could be used together; for example a raised portion could include a deformable projection which extends upwardly further than the raised portion itself.

In addition to storing epoxy in the tube to retain a later-inserted dowel, grooves or depressions may be manufactured into the inner wall of the tube itself. Such grooves or depressions, in concert with a glue, would provide a frictional or other retaining mechanism to retain the dowels within the tubes after insertion of the dowels. For example, as illustrated by the exemplary embodiment shown in FIG. 14, such grooves or depressions could be a groove or grooves formed as a circumferential ring or rings forming a trough or troughs 44 which provides frictional or other mechanical resistance, in concert with a glue, to preclude removal of the dowel below a specified amount of extraction force.

Still further, inwardly-projecting protrusions may be provided on the inside of a hollow dowel insert tube which comprise simple raised dimples or depositions of material which contact a dowel and thus provide a frictional retaining force which prevents the dowel from being released below a particular force level. Alternatively, such inwardly-projecting protrusion could be a raised portion of material which is angled to provide a flush mating with the inner wall of the tube at the top of the protrusion, but provide a step at the bottom portion of the protrusion, thus preventing any dowel having a latching ridge from being removed from the tube once the latching ridge has passed below the protrusion step. Still further, such inwardly-projecting protrusion could be a rib or similar member oriented parallel to the longitudinal direction of the tube and placed circumferentially around the inside diameter of the tube, for example three ribs spaced equally around the inner circumference of the tube. Such ribs would be designed to crush or deform when a dowel is inserted so as to provide a frictional or locking contact to retain the dowel in place below a specified amount of release force.

It should be appreciated that any number of internal protrusions or ribs, any number of internal grooves or depressions in concert with glue, or any other mechanism which provides the stated functionality to retain a dowel in an insert tube/concrete slab fall within the scope of this disclosure. It should also be appreciated that the specified amount of force referred to above would be a function of the protrusion(s) in the inwardly-projecting protrusion embodiment and would be designed to provide particular retention and/or release functionality. In other words, an engineering design specification would be established for release force and then the protrusion designed not to yield below that release force, as would be known to a person of skill in the art. Alternatively, the protrusions/retaining mechanism could be designed to prevent release of the dowel below an extremely high force level rendering the connection essentially unreleasable, thereby necessitating the cutting or shearing of the dowels if removal is deemed appropriate. Such a non-releasing mechanism would be appropriate, for example, in situations where a rigid connection is desired between the anchoring slab and whatever the dowel might be connected to, e.g., a permanent vertical concrete wall to name but one example. Similarly, in the groove/depression and glue embodiment, the structure created by the dowel, the glue and the grooves or depressions would preclude release or removal of a dowel below a specified or desired release force.

Figure 15:
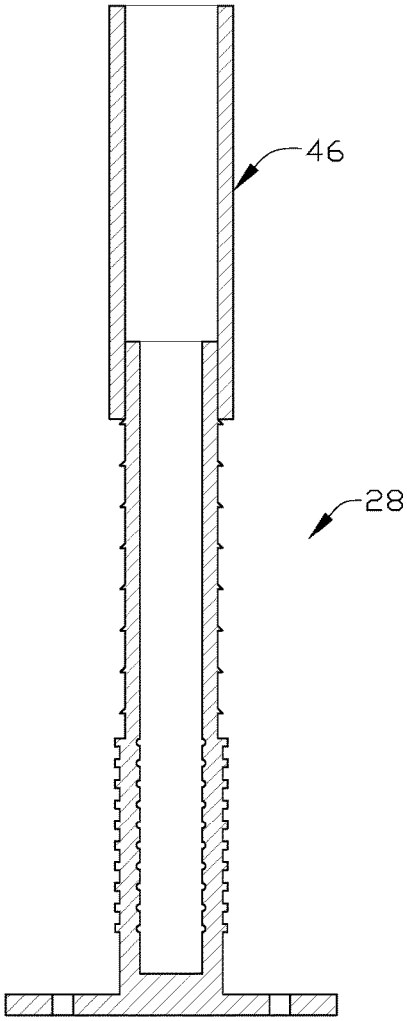
FIG. 15 is a section view of a dowel insert tube and dowel insert tube extender.

In other embodiments, as illustrated in exemplary embodiments shown in FIG. 15, a dowel insert tube extender 46 may be provided to accommodate different, thicker, concrete slab thicknesses than a particular insert tube may be capable of accommodating (i.e., providing a dowel placement mechanism in a concrete slab without the insert tube being covered up during a concrete pour due to the dowel support tube being shorter than the thickness of the concrete slab). Such extender may, in a typical implementation, have substantially the same internal dimension as an insert tube, and would sit on top of the insert tube, being held in place, for example, by an offset ring of material on the bottom of the extender which allows mating engagement between the insert tube and the extender and holds the extender in place during a concrete pour. Also, the same function could be provided by placing the offset ring of material on the inside circumference of the extender such that it fits into the top of the insert tube during use, and is held in place by said engagement. A separate collar could likewise be provided which would join the top end of the lower tube and the bottom end of the extender tube. Similarly, the extender tube could have an inside diameter which fits over the top portion of the lower tube, with a projection on the lower tube which stops the extender tube at the appropriate height such that the top of the extender tube is at the correct height with respect to the poured concrete slab, as shown in FIG. 15. Any technique known to a person of skill in the art for providing a mating engagement between the first (lower) dowel insert tube and an extender tube to retain the extender tube in place during a concrete pour is within the scope of the invention.

The present invention may further include ties 32. In certain embodiments, the ties 32 may be rigid plastic ties 32. The ties 32 may be used to align the dowel insert tubes 28 prior to the concrete filling. The ties 32 may be substantially straight and have a substantially flat body portion, which may include openings 42. The openings 42 may fit over the upper 10 and mid sections 14 and may rest on the lip of the leg section 12. Therefore, the dowel insert tubes 28 may be easily aligned prior to mounting the base 16. In certain embodiments, the ties 42 may include ends that may be joined with one another. The ends may pivot relative to one another so that a user may align the dowel insert tubes 28 at angles.

A method of securing the dowels during construction may include the following. At least one substantially hollow tube having a top end and a bottom end may be provided. The hollow tube may form an opening at the top end, and the bottom end may include a base. The base may be fastened to a concrete deck.

Concrete may be poured into the concrete deck and surround the hollow tubes. The concrete may solidify around the hollow tubes. Dowels may then be placed within the tubes when construction is ready to continue.

In certain embodiments, the at least one substantially hollow tube may be a plurality of substantially hollow tubes. Therefore a tie having a substantially flat body portion having openings may be provided. The tie may be placed over the plurality of substantially hollow tubes to align the plurality of substantially hollow tubes prior to fastening the hollow tubes to the concrete deck. This allows for proper alignment of the dowels once inserted into the tubes.

Figure 14:
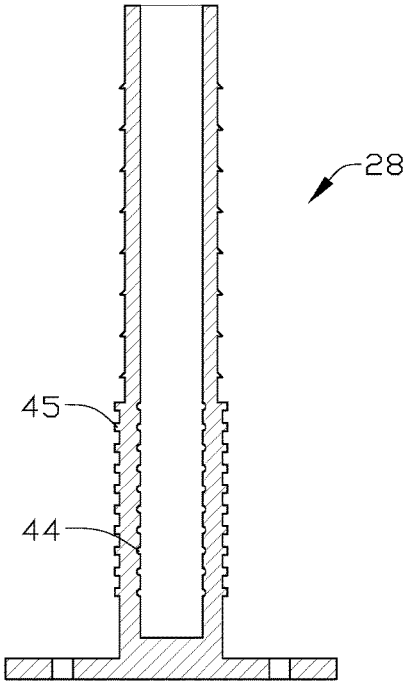
FIG. 14 is a section view of a dowel insert tube with internal grooves and external projections.

In certain embodiments as illustrated by FIG. 14, the dowel tube may have rings, ridges or other raised portions of material 45 on its exterior surface which produce a rigid, non-detachable connection to the concrete slab once the slab has cured.

Various of the disclosed embodiments detailed herein, as well as embodiments encompassed by the appended claims, thus provide a system or apparatus which, inter alia, requires substantially less material than previous approaches. Reduction of material and labor required occurs because configuration of a dowel projecting from a concrete slab is not required prior to the concrete pour. This eliminates the work and material required to configure the reinforcing material in the slab with a projecting reinforcing member to serve as a dowel to connect with future-poured slabs, walls or other structures. A further labor savings results from the elimination of the necessity of having to trowel around projecting dowels during working of the surface of a slab. A further labor and cost savings occurs by eliminating the need to place OSHA "orange caps" on every projecting dowel which is integrally formed with a poured slab in prior approaches. Still further, the present invention provides a much safer work environment by eliminating projecting dowels entirely until they actually need to be placed at the time a slab, wall or other structure is connected to a previously poured slab.

It should be understood, of course, that the foregoing relates to exemplary embodiments of the invention and that modifications may be made without departing from the spirit and scope of the invention as set forth in the following claims.

What is claimed is:

1. A dowel supporting device comprising:

a substantially hollow tube having an internal diameter and a top end and a bottom end distal from the top end, wherein the substantially hollow tube forms an opening at the top end leading into the substantially hollow tube, wherein the tube is sized to receive and secure a dowel by insertion of a dowel through the opening at the top end;

a base at the bottom end of the hollow tube distal from the top end, wherein the base is supported by a concrete deck such that the hollow tube is in an upright vertical position relative to the concrete deck, wherein the concrete deck is a substantially horizontal surface configured to receive a concrete pour to produce a substantially horizontal concrete slab, wherein the dowel is inserted into the opening at the top end of the hollow tube after the concrete around the hollow tube has solidified and wherein the dowel is supported by the hollow tube in an upright vertical position; and wherein the hollow tube contains an inner wall having one or more circumferential grooves in said inner wall of the hollow tube to retain the dowel in the hollow tube in concert with a glue which hardens into the grooves.

2. The dowel supporting device of claim 1 wherein the circumferential grooves in concert with said glue provide a frictional or other mechanical retaining force to the dowel to retain the dowel in place.

3. The dowel supporting device of claim 2, wherein the circumferential grooves are manufactured into or integral with the inner wall of the hollow tube.

4. The dowel supporting device of claim 3, wherein the circumferential grooves are comprised of circular troughs.

5. The dowel supporting device of claim 1, wherein the circumferential grooves in the hollow tube provide a latch in concert with said glue and one or more protrusions on said dowel to retain the dowel in place, wherein the one or more protrusions on the dowel are configured to slip past the circumferential grooves in the inner wall of the hollow tube during insertion of the dowel into the hollow tube to provide, in concert with said glue, a latch to prevent removal of the dowel from the hollow tube after the glue is cured.

6. The dowel supporting device of claim 1, wherein at least the hollow tube includes outwardly directed projections or rings of material on its outer circumferential surface which provide frictional or other mechanical resistance to prevent the tube from being pulled out of a cured concrete slab.

7. The dowel supporting device of claim 1, further comprising a dowel extender tube component having an internal diameter and a top end and a bottom end distal from the top end which has substantially the same internal diameter as the hollow tube, wherein the dowel extender tube is configured for mating engagement of the bottom end of the extender tube with the top end of the hollow tube, wherein the extender tube is in longitudinal alignment with the hollow tube such that the hollow tube is extended in length and the extender tube is held in place during a concrete pour, wherein the top end of the extender tube extends at or above the concrete slab surface after the slab solidifies.

8. The dowel supporting device of claim 1, further comprising a thin sealed covering at the top end of the hollow tube to cover the opening at the top end during a concrete pour, and wherein the covering is punctured by the dowel during dowel insertion after the concrete solidifies around the tube, wherein the thin sealed covering further includes an upwardly extending projection or raised portion of material at its top-most surface to aid in locating the hollow tube after concrete has cured around it.

9. The dowel supporting device of claim 1, further comprising a thin sealed covering at the top end of the hollow tube to cover the opening at the top end during a concrete pour, and wherein the covering is punctured by the dowel during dowel insertion after the concrete solidifies around the tube, wherein the thin sealed covering further includes a deformable projection which extends upward and wherein the deformable projection is capable of elastically deforming or bending during working or troweling of the surface of a wet concrete slab such that the projection substantially returns to its original undeformed state after a working implement passes over it, thereby producing a vertically extending projection which aids in locating the hollow tube after the slab cures.

10. A dowel supporting device comprising:

a first substantially hollow tube having an internal diameter and a top end and a bottom end distal from the top end, wherein the first substantially hollow tube forms an opening at the top end leading into the first substantially hollow tube;

a base at the bottom end of the first hollow tube distal from the top end, wherein the base is supported by a concrete deck such that the first hollow tube is in an upright vertical position relative to the concrete deck, wherein the concrete deck is a substantially horizontal surface configured to receive a concrete pour to produce a substantially horizontal concrete slab; and a dowel insert tube extender comprising a second hollow tube having an internal diameter and a bottom end and a top end and an opening at the top end, wherein the second hollow tube is sized to receive and secure a dowel by insertion of a dowel through the opening at the top end wherein the bottom end of said second hollow tube is configured for mating engagement with the top end of said first hollow tube, said second hollow tube having substantially the same internal diameter as the first hollow tube;

wherein the hollow tubes are configured for insertion of the dowel into the opening at the top end of the second hollow tube and to continue into the first hollow tube after the concrete around the first and second hollow tubes has solidified and wherein the dowel is supported by the hollow tubes in an upright vertical position.

11. The dowel supporting device of claim 10, wherein the dowel insert tube extender is configured to be held in place during a concrete pour by an offset ring of material situated on the outside surface of the top end of the first hollow tube, wherein the dowel insert tube extender is configured to slip over the top end of the first hollow tube to provide mating engagement between the first hollow tube and insert tube extender and hold the extender in place during a concrete pour, and wherein the offset ring of material situated on the outside surface of the top end of the first hollow tube positions the extender tube at a predetermined height such that the top of the extender tube is at a desired height with respect to the poured concrete slab.

12. The dowel supporting device of claim 10, further comprising a thin sealed covering at the top end of the second hollow tube to cover the opening at the top end of said tube during a concrete pour, and wherein the covering is punctured by the dowel during dowel insertion after the concrete solidifies around the tube, wherein the thin sealed covering further includes a deformable projection which extends upward wherein the deformable projection is capable of elastically deforming or bending during working or troweling of the surface of a wet concrete slab such that the projection substantially returns to its original undeformed state after a working implement passes over it, thereby producing a vertically extending projection which aids in locating the hollow tube after the slab cures.

13. The dowel supporting device of claim 10, wherein the dowel is secured within the hollow tube after insertion of the dowel into the tube by one or more circumferential grooves on the inner wall of the hollow tube to retain the dowel in the hollow tube, in concert with a glue, by providing a frictional or other mechanical retaining force to the dowel to retain the dowel in place once the glue has cured.

14. The dowel supporting device of claim 13, wherein the glue is an epoxy placed within at least one of the hollow tubes prior to pouring of a concrete slab which secures the dowel within said hollow tube after insertion of the dowel and curing of the epoxy.

15. A dowel supporting device comprising:

a first substantially hollow tube having an inner circumference and a top end and a bottom end distal from the top end, wherein the first substantially hollow tube forms an opening at the top end leading into the first substantially hollow tube;

a base at the bottom end of the first hollow tube distal from the top end, wherein the base is supported by a concrete deck such that the first hollow tube is in an upright vertical position relative to the concrete deck, wherein the concrete deck is a substantially horizontal surface configured to receive a concrete pour to produce a substantially horizontal concrete slab; and a dowel insert tube extender comprising a second hollow tube having an inner circumference and a bottom end and a top end and an opening at the top end, wherein the second hollow tube is sized to receive and secure a dowel by insertion of the dowel through the opening at the top end wherein the bottom end of said second hollow tube is configured for mating engagement with the top end of said first hollow tube;

wherein the hollow tubes are configured for insertion of the dowel into the opening at the top end of the second hollow tube and to continue into the first hollow tube after the concrete around the first and second hollow tubes has solidified and wherein the dowel is supported by the hollow tubes in an upright vertical position; and wherein at least one of the first hollow tube or the second hollow tube contains one or more circumferential grooves in the inner wall of said hollow tube to retain the dowel in said hollow tube in concert with a glue.

16. The dowel supporting device of claim 15 wherein the circumferential grooves comprise at least one circumferential trough around the inner circumference of at least one of the first hollow tube or the second hollow tube to provide a frictional or other mechanical retaining force to the dowel, in concert with said glue, to retain the dowel in place after the glue is cured.

17. The dowel supporting device of claim 16, wherein the circumferential grooves are manufactured into or integral with the inner wall of the first hollow tube or the second hollow tube.

18. The dowel supporting device of claim 15, wherein the circumferential grooves in the first hollow tube or the second hollow tube provide a latch in concert with said glue and one or more protrusions on the dowel to retain the dowel in place, wherein the one or more protrusions on the dowel are configured to slip over the circumferential grooves in the inner wall of the hollow tube during insertion of the dowel into the hollow tube to provide, in concert with said glue, a latch to prevent removal of the dowel from the hollow tube after the glue is cured.

19. The dowel supporting device of claim 15, further comprising a thin sealed covering at the top end of the second hollow tube to cover the opening at the top end of said tube during a concrete pour, and wherein the covering is punctured by the dowel during dowel insertion after the concrete solidifies around the tube, wherein the thin sealed covering further includes a deformable projection which extends upward wherein the deformable projection is capable of elastically deforming or bending during working or troweling of the surface of a wet concrete slab such that the projection returns to its original undeformed state after a working implement passes over it, thereby producing a vertically extending projection which aids in locating the hollow tube after the slab hardens.

20. The dowel supporting device of claim 15, wherein said glue is comprised of an epoxy placed within at least one of the hollow tubes prior to pouring of a concrete slab which secures the dowel within said hollow tube after insertion of the dowel and wherein at least the first hollow tube includes outwardly directed projections or rings of material which provide frictional or other mechanical resistance to prevent the tube from being pulled out of a cured concrete slab.

* * * * *